US009776065B2

(12) United States Patent
Bjertnaes

(10) Patent No.: US 9,776,065 B2
(45) Date of Patent: Oct. 3, 2017

(54) SKI, OR SIMILAR DEVICE FOR SLIDING ON SNOW, HAVING A MOUNTING AID FOR A BINDING

(75) Inventor: Gunnar Bjertnaes, Lillehammer (NO)

(73) Assignees: Rottefella AS (NO); Madshus AS (NO)

( * ) Notice: Subject to any disclaimer, the term of this patent is extended or adjusted under 35 U.S.C. 154(b) by 640 days.

(21) Appl. No.: 11/813,610

(22) PCT Filed: Jan. 10, 2005

(86) PCT No.: PCT/IB2005/000032
§ 371 (c)(1),
(2), (4) Date: Aug. 21, 2007

(87) PCT Pub. No.: WO2006/072812
PCT Pub. Date: Jul. 13, 2006

(65) Prior Publication Data

US 2008/0203703 A1 Aug. 28, 2008

(51) Int. Cl.
*A63C 5/12* (2006.01)
*A63C 9/00* (2012.01)
*A63C 5/00* (2006.01)

(52) U.S. Cl.
CPC ..... *A63C 9/003* (2013.01); *A63C 5/003* (2013.01); *A63C 5/128* (2013.01)

(58) Field of Classification Search
CPC ..... A63C 5/003; A63C 5/128; A63C 9/003
USPC ..... 280/607, 609, 610, 617, 618; 441/70
See application file for complete search history.

(56) References Cited

U.S. PATENT DOCUMENTS

| | | | | |
|---|---|---|---|---|
| 1,964,103 | A | 6/1934 | Attenhoffer | |
| 2,094,667 | A | 10/1937 | Parish | |
| 3,137,014 | A | 6/1964 | Meucci | |
| 3,797,839 | A * | 3/1974 | Smolka et al. | 280/617 |
| 3,797,844 | A * | 3/1974 | Smolka et al. | 280/617 |
| 3,894,745 | A * | 7/1975 | Heim et al. | 280/610 |
| 3,950,001 | A | 4/1976 | Weigl | |
| 3,966,218 | A | 6/1976 | Beyl | |
| 4,071,264 | A * | 1/1978 | Legrand et al. | 280/610 |
| 4,093,268 | A * | 6/1978 | Sampson et al. | 280/610 |
| 4,186,500 | A | 2/1980 | Salzman | |

(Continued)

FOREIGN PATENT DOCUMENTS

| | | |
|---|---|---|
| AT | 327066 | 1/1976 |
| AT | 354306 B | 1/1980 |

(Continued)

OTHER PUBLICATIONS

Office Action issued in U.S. Appl. No. 10/535,619 dated Jan. 22, 2010, which is directed to related subject matter.

(Continued)

*Primary Examiner* — Frank B Vanaman
(74) *Attorney, Agent, or Firm* — Knobbe Martens Olson & Bear LLP

(57) ABSTRACT

Ski or similar device for sliding on snow having a mounting plate (12) for a binding or for parts thereof, such as a binding plate and/or heel plate, which mounting plate is mounted on, especially bonded or welded to, the top face of the ski, wherein the mounting plate (12) is of foil-like form and is bondable or weldable onto the top face of the ski in such a manner that it effectively defines a structural unit therewith.

5 Claims, 4 Drawing Sheets

(56) References Cited

U.S. PATENT DOCUMENTS

| | | | | |
|---|---|---|---|---|
| 4,266,806 | A | 5/1981 | Weigl et al. | |
| 4,273,355 | A | 6/1981 | Storandt | |
| 4,310,170 | A | 1/1982 | Linecker | |
| 4,322,090 | A | 3/1982 | Loughney | |
| 4,522,424 | A | 6/1985 | Luitz et al. | |
| 4,524,990 | A | 6/1985 | Svoboda et al. | |
| 4,571,858 | A | 2/1986 | Faulin | |
| 4,586,727 | A | 5/1986 | Andrieu et al. | |
| 4,652,006 | A * | 3/1987 | Desoutter | 280/604 |
| 4,722,613 | A | 2/1988 | Jungkind | |
| 4,772,041 | A | 9/1988 | Klosterman et al. | |
| 4,887,833 | A | 12/1989 | Bailey | |
| 4,955,633 | A | 9/1990 | Stritzl et al. | |
| 4,974,867 | A | 12/1990 | Rullier et al. | |
| 5,029,889 | A | 7/1991 | Bejean et al. | |
| 5,088,756 | A | 2/1992 | Hue et al. | |
| 5,114,172 | A * | 5/1992 | Rousset et al. | 280/633 |
| 5,116,073 | A | 5/1992 | Goud et al. | |
| 5,125,680 | A | 6/1992 | Bejean et al. | |
| 5,143,395 | A | 9/1992 | Mayr et al. | |
| 5,190,309 | A | 3/1993 | Spitaler et al. | |
| 5,199,734 | A * | 4/1993 | Mayr | 280/602 |
| 5,207,445 | A * | 5/1993 | Hoelzl | 280/607 |
| 5,211,418 | A * | 5/1993 | Scherubl | 280/618 |
| 5,221,104 | A * | 6/1993 | Bejean et al. | 280/604 |
| 5,232,241 | A | 8/1993 | Knott et al. | |
| D345,454 | S | 3/1994 | Hauglin | |
| 5,333,889 | A | 8/1994 | Piegay et al. | |
| 5,333,890 | A * | 8/1994 | Bejean | 280/609 |
| 5,338,051 | A | 8/1994 | Szafranski et al. | |
| 5,344,178 | A | 9/1994 | Rohrmoser | |
| 5,344,179 | A | 9/1994 | Fritschi et al. | |
| 5,356,169 | A | 10/1994 | Hue et al. | |
| 5,372,370 | A * | 12/1994 | Rohrmoser | 280/610 |
| 5,431,427 | A | 7/1995 | Pieber et al. | |
| 5,480,175 | A * | 1/1996 | Astier et al. | 280/607 |
| 5,484,149 | A | 1/1996 | Lee | |
| 5,498,017 | A | 3/1996 | Rohrmoser | |
| 5,499,421 | A * | 3/1996 | Brice | 15/167.1 |
| 5,524,919 | A | 6/1996 | Sedlmair | |
| 5,597,170 | A * | 1/1997 | Le Masson et al. | 280/602 |
| 5,671,941 | A | 9/1997 | Girad | |
| 5,732,968 | A * | 3/1998 | Wladar et al. | 280/633 |
| 5,765,854 | A | 6/1998 | Moore et al. | |
| 5,785,342 | A | 7/1998 | Bronson | |
| 5,836,604 | A | 11/1998 | Piegay | |
| 5,897,127 | A | 4/1999 | Hauglin | |
| 5,899,006 | A | 5/1999 | Donnadieu | |
| 5,919,084 | A * | 7/1999 | Powell et al. | 451/344 |
| 5,924,719 | A | 7/1999 | Girard | |
| 5,944,336 | A * | 8/1999 | Fagot | 280/607 |
| 5,944,337 | A | 8/1999 | Girard et al. | |
| 6,017,050 | A | 1/2000 | Girard | |
| 6,065,895 | A | 5/2000 | Lehner et al. | |
| 6,092,829 | A | 7/2000 | Mercier | |
| 6,193,262 | B1 | 2/2001 | Silva | |
| 6,209,903 | B1 | 4/2001 | Girard | |
| 6,216,366 | B1 | 4/2001 | Donnadieu | |
| 6,244,616 | B1 | 6/2001 | Silva et al. | |
| 6,289,610 | B1 | 9/2001 | Girard et al. | |
| 6,315,318 | B1 * | 11/2001 | Caron et al. | 280/617 |
| 6,374,517 | B2 | 4/2002 | Girard et al. | |
| 6,390,493 | B1 | 5/2002 | Hauglin | |
| 6,402,184 | B1 | 6/2002 | Hauglin | |
| 6,450,510 | B1 | 9/2002 | Liu | |
| 6,471,235 | B1 | 10/2002 | Luitz et al. | |
| 6,499,761 | B1 | 12/2002 | Quellais | |
| 6,547,261 | B2 | 4/2003 | Gorza et al. | |
| 6,588,791 | B1 | 7/2003 | Hom | |
| 6,612,592 | B1 | 9/2003 | Soo | |
| 6,619,688 | B2 | 9/2003 | Billon et al. | |
| 6,631,918 | B2 * | 10/2003 | Silva | 280/607 |
| 6,670,018 | B2 * | 12/2003 | Fujita et al. | 428/86 |
| D488,294 | S | 4/2004 | Lancon | |
| 6,783,145 | B2 | 8/2004 | Deborde et al. | |
| 6,814,367 | B2 * | 11/2004 | Mercier et al. | 280/613 |
| 6,824,158 | B1 | 11/2004 | Keller et al. | |
| 6,848,703 | B2 | 2/2005 | Godde et al. | |
| 6,896,284 | B2 | 5/2005 | Kruajitch | |
| 6,923,464 | B2 | 8/2005 | Noviant | |
| 6,935,273 | B2 * | 8/2005 | Throndsen et al. | 119/431 |
| 7,036,842 | B2 | 5/2006 | Krumbeck et al. | |
| 7,055,846 | B2 | 6/2006 | Restani | |
| 7,077,419 | B2 | 7/2006 | Cuzzit et al. | |
| 7,207,591 | B2 | 4/2007 | Riedel et al. | |
| 7,264,263 | B2 | 9/2007 | Riedel et al. | |
| 7,984,921 | B2 | 7/2011 | Bjertnaes | |
| 8,460,505 | B2 | 6/2013 | Bjertnaes | |
| 2002/0105167 | A1 | 8/2002 | Mercier et al. | |
| 2003/0155742 | A1 | 8/2003 | Riedel et al. | |
| 2004/0164519 | A1 | 8/2004 | Quellais et al. | |
| 2004/0207177 | A1 | 10/2004 | Riedel et al. | |
| 2004/0262886 | A1 | 12/2004 | Girard | |

FOREIGN PATENT DOCUMENTS

| | | | |
|---|---|---|---|
| CH | 557154 | | 12/1974 |
| DE | 1929885 | | 12/1970 |
| DE | 2418577 | A | 10/1975 |
| DE | 2645007 | | 4/1978 |
| DE | 2714853 | A | 10/1978 |
| DE | 2728747 | A | 1/1979 |
| DE | 3113942 | A1 | 10/1982 |
| DE | 3222132 | A1 | 12/1983 |
| DE | 3527219 | A1 | 2/1986 |
| DE | 38 38 569 | | 6/1989 |
| DE | 38 38 569 | A1 | 6/1989 |
| DE | 3924939 | A1 | 5/1990 |
| DE | 69100491 | T3 | 10/1991 |
| DE | 4229039 | | 4/1993 |
| DE | 3785420 | T2 | 10/1993 |
| DE | 9320530 | | 10/1994 |
| DE | 19517791 | A1 | 11/1996 |
| DE | 19753451 | | 6/1999 |
| DE | 20007032 | U1 | 8/2000 |
| DE | 102004023832 | A1 | 11/2002 |
| DE | 10124893 | | 11/2003 |
| DE | 102004018296 | A1 | 2/2005 |
| DE | 10319675 | | 6/2005 |
| EP | 0029206 | A | 5/1981 |
| EP | 0346414 | | 12/1989 |
| EP | 0506064 | A1 | 9/1992 |
| EP | 0787440 | | 8/1997 |
| EP | 0820790 | A2 | 1/1998 |
| EP | 0 878 218 | | 11/1998 |
| EP | 0908204 | A2 | 4/1999 |
| EP | 0951926 | A | 10/1999 |
| EP | 1 240 925 | | 9/2002 |
| FR | 2556188 | A1 | 6/1985 |
| FR | 2 569 119 | | 2/1986 |
| FR | 2741543 | | 5/1997 |
| FR | 2742060 | | 6/1997 |
| FR | 2803178 | A1 | 7/2001 |
| NO | 319529 | | 7/2003 |
| WO | WO 88/04563 | | 6/1988 |
| WO | WO 93/16769 | | 9/1993 |
| WO | WO 96/23558 | | 8/1996 |
| WO | WO 01/66204 | | 9/2001 |
| WO | WO 02/49728 | | 6/2002 |
| WO | WO 03/002217 | A2 | 1/2003 |
| WO | WO 03/101555 | | 12/2003 |
| WO | WO 2004/045728 | | 6/2004 |

OTHER PUBLICATIONS

Opposition filed by Fisher Sports GmbH on Dec. 23, 2009 against EP 1 846 116 B1, which corresponds to U.S. Appl. No. 11/813,610.

International Search Report for PCT/IB2003/05332, which corresponds to U.S. Appl. No. 10/535,619.

International Search Report for PCT/IB2005/000032, which corresponds to U.S. Appl. No. 11/813,610.

Response to Office Action dated Jan. 22, 2010 in U.S. Appl. No. 10/535,619.

(56) References Cited

OTHER PUBLICATIONS

Rilsan® product info "Key Properties (Metric Units)", extract from Internet, www.arkema.com cited in opposition.
Supplemental European Search Report for EP 09177504.9, which corresponds to U.S. Appl. No. 11/813,610.
Translation if International Preliminary Report on Patentability for PCT/IB2005/000032, which corresponds to U.S. Appl. No. 11/813,610.
Office Action dated Oct. 1, 2010, for U.S. Appl. No. 10/535,619, which is directed to related subject matter.
Response to Opposition filed Aug. 5, 2010 on behalf of Madshus AS in European Patent No. 1 846 116 B1.
Schultes, Hermann, "The Alpine Ski," Olin Ski Co., 1980, Chapter 2.9.4 "Modern Adhesives for the Ski Industry"; Cover page and pp. 99-105; cited in opposition proceedings against EP 1846116.
Data Sheet Araldit AW 106, Härter HV 953, published Mar. 1998 and cited in opposition proceedings against EP 1562682, 8 pages.
Interlocutory decision in opposition proceedings dated Aug. 10, 2012 against EP Patent No. 1562683.
Overview Table of a Ski Cross-Section, undated; cited in opposition proceedings against EP 1846116.
Opposer's Contentions filed Dec. 16, 2011 submitting additional references in opposition proceedings against European Patent No. EP 1846116; 2 pages.
Printout of "Kleben" (Cling) from Wikipedia cited on Oct. 6, 2010 in European Opposition by Fischer Sports GmbH against EP 1562683 as Exhibit 5 with English translation obtained from Wikipedia; 9 pages.
Printout of "Elastizitätsmodul" ("Elasticity Modulus") from Wikipedia cited on Dec. 23, 2009 in European Opposition by Fischer Sports GmbH against EP 1846116 as Exhibit 2 with English translation obtained from Wikipedia; 7 pages.
Printout of "Laminat" ("Laminate") from Wikipedia cited on Dec. 23, 2009 in European Opposition by Fischer Sports GmbH against EP 1846116 as Exhibit 7 with English translation obtained from Wikipedia; 13 pages.
Office Action dated Nov. 15, 2013 for Norwegian Patent Application No. 20074046.

* cited by examiner

II
10
36

VI
VI
37
38
12
39
40
II
Pat. Pend.
36

12
30
AA
31
12

SKI, OR SIMILAR DEVICE FOR SLIDING ON SNOW, HAVING A MOUNTING AID FOR A BINDING

CROSS REFERENCE TO RELATED APPLICATIONS

This application claims the benefit and priority to and is a U.S. National Phase of PCT International Application Number PCT/IB2005/000032, filed on Jan. 10, 2005. The disclosures of the above-referenced application is hereby expressly incorporated by reference in its entirety.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION (1) Field of the Invention

The invention relates to a ski or similar device for sliding on snow having a mounting plate for a binding or for parts thereof, such as a binding plate and/or heel plate, which mounting plate is mounted on, especially bonded or welded to, the top face of the ski.

(2) Description of Related Art

The arrangement of mounting aids in the form of so-called binding plates on the top face of a ski is generally known. The binding plate is generally fastened to the top face of the ski by means of screws. In order for the screws to have sufficient hold in the ski or ski body, the ski body needs to be formed with separate reinforcement in the region in which the binding plate is fastened. As a rule, this is achieved by the integration of a solid wood core or of a separate mounting plate made of plastics or metal into the binding region of a ski or snowboard. Clearly, such reinforcing inserts have an appreciable influence on the flexural strength and torsional rigidity of the ski, on the one hand, and on the flexibility of the ski, on the other hand. In addition, they increase the weight of the ski by a not inconsiderable amount. To find a remedy for that, it is proposed in WO 2004/045728 A2 to provide a mounting aid in the form of a mounting plate bonded or welded to the top face of the ski, onto which plate the binding or parts thereof, such as a binding plate and/or heel plate, can then be mounted in a simple manner. The fastening of the mounting plate is not to affect the properties of the ski. Accordingly, ski and mounting plate are to form an integral structural unit in terms of the mechanical properties, such as thermal expansion, tensile strength, flexural strength and torsional rigidity etc. Ski and mounting plate are to be connected to one another as though they constituted a one-piece structural unit. For that purpose, the mounting plate is preferably welded or bonded substantially over the whole surface to the top face of the ski. In terms of process technology, the application of the mounting plate can either take place after the ski has been produced or can be effected together with the top layer of the ski. The mounting plate has an undercut longitudinal guide for the longitudinal positioning and fixing of the binding or of binding parts. Fixing is effected preferably by means of clamping screws, which are associated with the binding or the binding parts and co-operate with the mounting plate. In a preferred implementation, the mounting plate is approximately T-shaped or U-shaped in cross-section, wherein, in the first case, the transverse land extends spaced from, and parallel to, the top face of the ski, with the result that it is possible for the binding housing or a binding plate to engage beneath the two lateral longitudinal edges of the mounting plate so formed. In the last-mentioned implementation, with the U-shaped mounting plate, the two upwardly projecting arms thereof are each drawn inwards in the shape of a hook, with the result that a longitudinal guide rail is formed having longitudinal edges undercut on the inside which engage over a binding housing or a binding plate and/or heel plate.

BRIEF SUMMARY OF THE INVENTION

The aim of the present invention is to simplify and improve the last-mentioned construction technologically both in terms of manufacture and handling. In addition, the intention is that any possible effect of the mounting plate on the flexural strength and torsional rigidity and on the flexibility of the ski be reduced to near zero.

That aim is achieved by a construction according to the characterising features of claim 1, preferred details and further developments being described in the sub-claims.

Accordingly, the mounting plate bonded or welded to the top face of the ski is to be of very thin form, that is, of foil-like form. The mounting plate thus no longer constitutes an external foreign body of the ski. The mounting plate effectively forms a structural unit with the top face of the ski. Preferably, the mounting plate is produced by injection moulding. Alternatively, however, it is also possible for the mounting plate to be stamped from a plastics foil, wherein it is preferably produced from acrylonitrile/butadiene/styrene copolymer (APS). That plastics material can, as required, be reinforced by carbon fibres.

As has already been mentioned in connection with the prior art, it is really important that the mounting plate be bonded or welded substantially over the whole surface to the top face of the ski. The mounting plate therefore behaves like an integral component of the top face of the ski or of the top lamina defining the top face of the ski. In addition, as a result of that kind of join, there are no local stress locations, especially punctiform stress locations, as represented, for example, by screw fastenings. It is accordingly also guaranteed that high tensile forces can be applied to the mounting plate without there being any destructive effect. The bonding or welding join returns to its original state once the stress has ceased (hysteresis). The construction as a rule "forgives" overloads. The situation is different in the case of punctiform screw fastenings. When there is excessive tension on a screw fastening, the latter is loosened. A return to the original fastening state is not guaranteed.

It is furthermore of great importance for the mounting plate to have integral locking channels which co-operate with corresponding locking elements of the binding or of a binding plate and/or heel plate. The locking channels are thus formed in one piece with the mounting plate, and are especially integrally formed in the same.

The two longitudinal edges of the mounting plate are preferably raised relative to a central base portion, so that they define an undercut longitudinal guide for the binding or a binding plate. The mounting plate thus has a U-shaped cross-section, the two arms at its upper longitudinal edges each being curved outwards in order to define the said undercut.

To ensure that the mounting plate does not exert any influence on the so-called "flex" of the ski, the mounting plate has a modulus of elasticity "E" that is appreciably lower than that of the ski body. Preferably, the modulus of elasticity "E" of the mounting plate corresponds to that of the top lamina defining the top face of the ski.

In a preferred embodiment, the modulus of elasticity "E" of the mounting plate is approximately from 500 to 2000 MPa compared with a customary modulus of elasticity of the ski body in the range from 10-60 GPa.

It is possible, in principle, for the mounting plate to be constructed as part of the ski-top-face lamina, that is, for the ski-top-face lamina to be replaced in the central region of the ski by the mounting plate. That variant is, of course, available primarily only to the ski manufacturer because of the marked effect of that construction on the manufacturing process of a ski.

When the mounting plate is produced from plastics material, its thickness is approximately from 1.5 to 3.5 mm, especially approximately from 2.0 to 3.0 mm. Ultimately, the thickness of the mounting plate depends also on the required strengths. For stiffening the mounting plate irrespective of the material thereof, in addition longitudinal lands may be provided.

In the following, a preferred embodiment of a mounting plate integrated in accordance with the invention is explained in detail with reference to the accompanying drawings in which:

DETAIL DESCRIPTION OF THE INVENTION

Figures 1, 2:
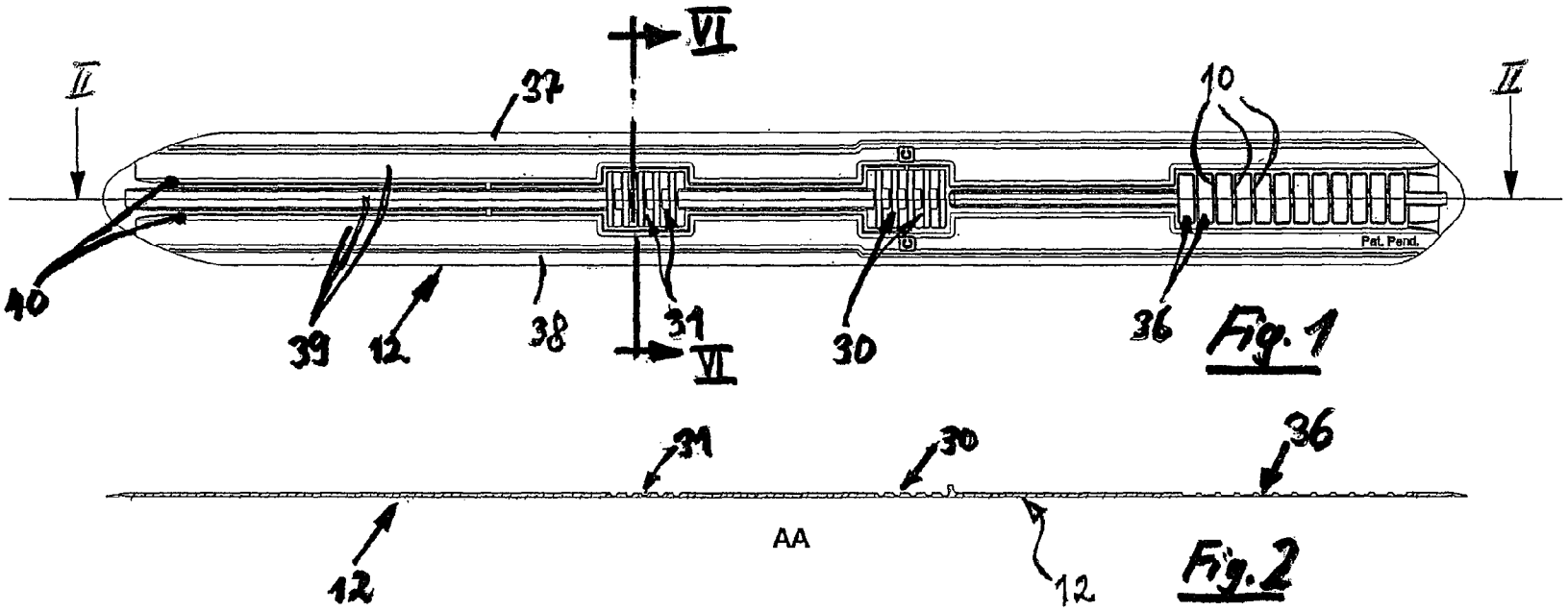
FIG. 1 is a plan view of a mounting plate formed in accordance with the invention for bonding or welding over the whole face to the top face of a ski.
FIG. 2 is a longitudinal section of the mounting plate according to FIG. 1 along the line II-II in FIG. 1.
Figure 3:
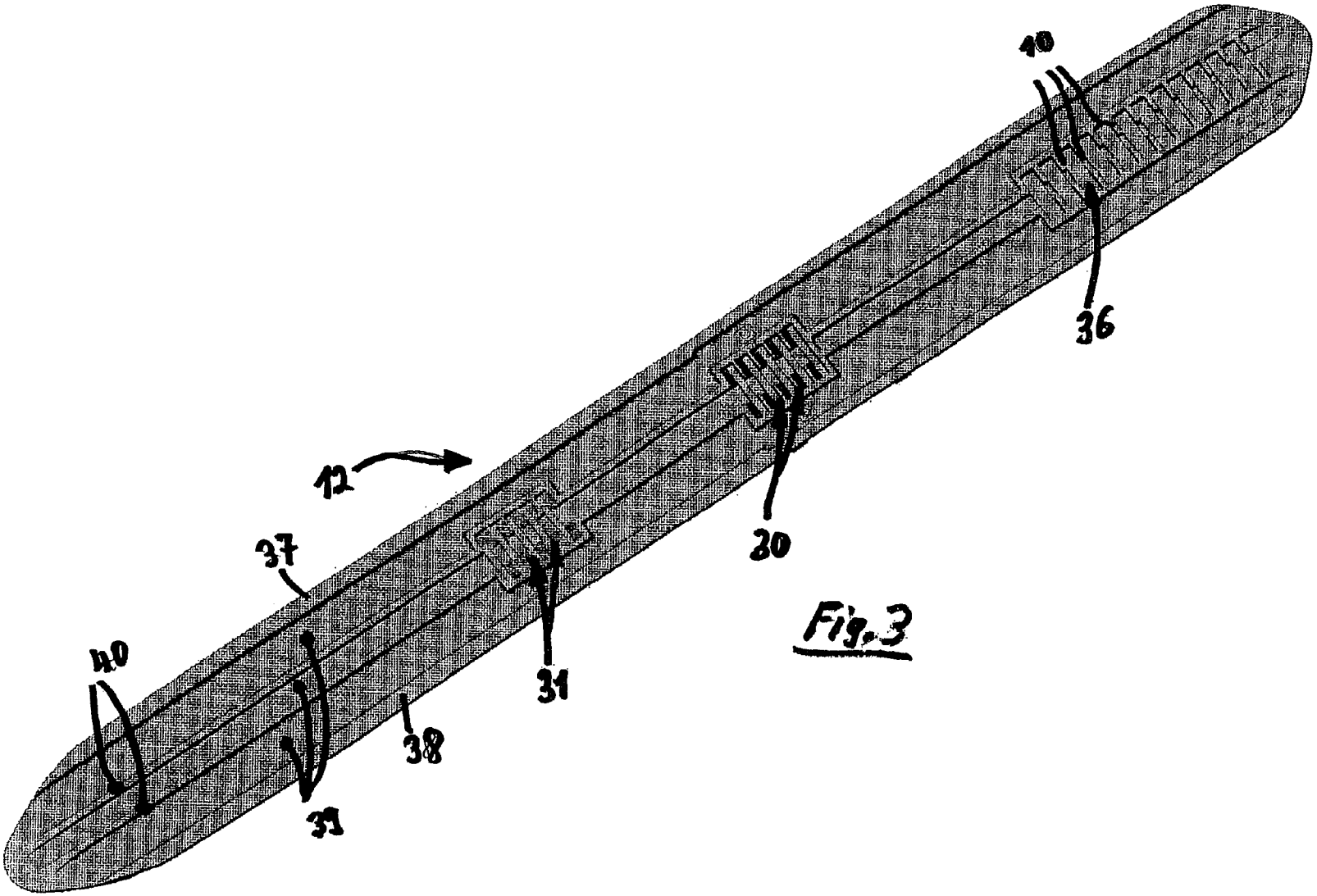
FIG. 3 is an inclined top view, in perspective, of a mounting plate corresponding to that according to FIG. 1.

Shown in FIGS. 1 to 3 is a mounting plate 12 which is of foil-like form. It is a mounting plate that can be produced by injection moulding. In the central region it has two panels of channels 30, 31, and in the heel region it has locking recesses 36. Both the channels 30, 31 and the locking recesses 36 are integrally formed in the mounting plate. They co-operate lockingly with complementary locking projections on the underside of a binding or binding plate or heel plate. The mounting plate 12 according to FIGS. 1 to 3 is accordingly suitable for locating a front binding plate, with or without integral binding housing, at one end and locating a heel plate, formed separately therefrom, at the other end. The channels 30, 31 are each bounded by inclined tooth profiles, the inclined tooth profiles associated with the front channels 31 each having a rear vertical flank and an inclined front flank that slopes away forwards, whereas the inclined tooth profiles associated with the rear channels 30 are each defined by a front vertical flank and an inclined flank that slopes away rearwards. Accordingly, the binding or the binding housing or a binding plate needs to include a complementary locking means having a first locking unit active only towards the front and a second locking unit active only towards the rear so that, when the locking unit active only towards the front is released, the binding is displaceable only towards the front and, when the locking unit active only towards the rear is released, the binding is displaceable only towards the rear. The locking recesses 36 are by contrast symmetrically formed. They are separated from each other in each case by transverse lands 10.

The mounting plate 12 according to FIGS. 1 to 3 is preferably bonded or welded to the ski top face at the ski manufacturer's. Since the mounting plate 12 bears against the ski top face over a large area, it is also possible for a bonding or welding join of correspondingly large area to be produced. The advantage of that large-area join has already been described hereinabove.

The two longitudinal edges 37, 38 of the mounting plate 12 are raised relative to a central base portion 39, so that they define an undercut longitudinal guide for the binding or a binding plate. Furthermore, it can also be seen from FIGS. 1 and 2 that the mounting plate 12 comprises central longitudinal lands 40, which are interrupted by the front and rear locking channels 31 and 30 and also by the locking recesses 36 arranged in addition in the heel region.

In respect of the locking elements of the binding, or of parts of the binding, associated with the locking channels 30, 31 and with the locking recesses 36, it should also be mentioned that they are preferably integral components of the binding or of parts of the binding. The locking elements are preferably formed as tabs joined in one piece with the binding, a binding housing or a binding plate and/or a heel plate, on the underside of which tabs there is formed a locking projection which co-operates with the locking channels 30, 31 and locking recesses 36. The locking channels and locking projections can, of course, also be provided in converse manner on the mounting plate on the one hand and on the binding or a heel plate on the other hand. Attention is at this point again drawn to the fact that the mounting plate has approximately the same values in terms of thermal expansion tensile strength flexural strength and torsional rigidity as the associated fastening portion on the ski. In order that the flexural behaviour of the ski is not affected or is affected only to a small extent, the mounting plate 12 has a modulus of elasticity "E" that is appreciably lower than that of the ski body, especially a modulus of elasticity corresponding to that of the top lamina defining the top face of the ski. The mounting plate 12 then behaves like an integral component of the ski body or of the top lamina.

As already stated at the outset, the thickness of the mounting plate 12 is approximately from 1.5 to 3.5 mm, preferably approximately 3.0 mm. The thickness of the mounting plate naturally also depends on the material used therefor, which in turn also affects the required strength of the mounting plate, especially of the guide edges 37, 38.

Figure 4:
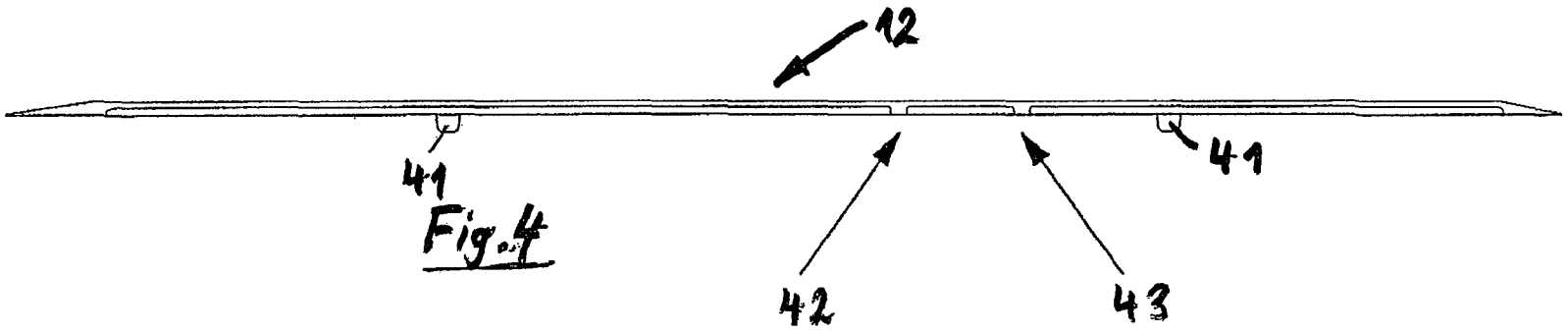
FIG. 4 is a lateral view of a mounting plate corresponding to that according to FIG. 1, showing positioning lugs or pins on the underside.

FIG. 4 is a lateral view of the mounting plate according to FIG. 1 from which it can be seen that there are provided on, especially formed on, the underside of the mounting plate 12, that is, on the side facing the top face of the ski, two approximately centrally arranged positioning pins 41, longitudinally spaced from each other, that correspond to corresponding positioning openings—not shown here—in the top face of the ski. By that means bonding of the mounting plate 12 to the top face of the ski is possible at the particular location provided without there being any risk of slippage.

Furthermore, it can also be seen from FIG. 4 that there are provided at the two longitudinal sides of the mounting plate 12, here in the region of the undercut longitudinal guide, two projections 42, 43 longitudinally spaced from each other which act as a movement stop for a binding or binding plate pushed onto the mounting plate 12 from the front, that is from the left in FIG. 1, on the one hand, and for a heel plate pushed onto the mounting plate from the rear, that is from the right in FIG. 1, on the other hand. The front projection 42 acts as a stop for movement of the binding or binding plate towards the rear, whereas the rear projection 43 limits displacement of the heel plate towards the front.

Figure 5:
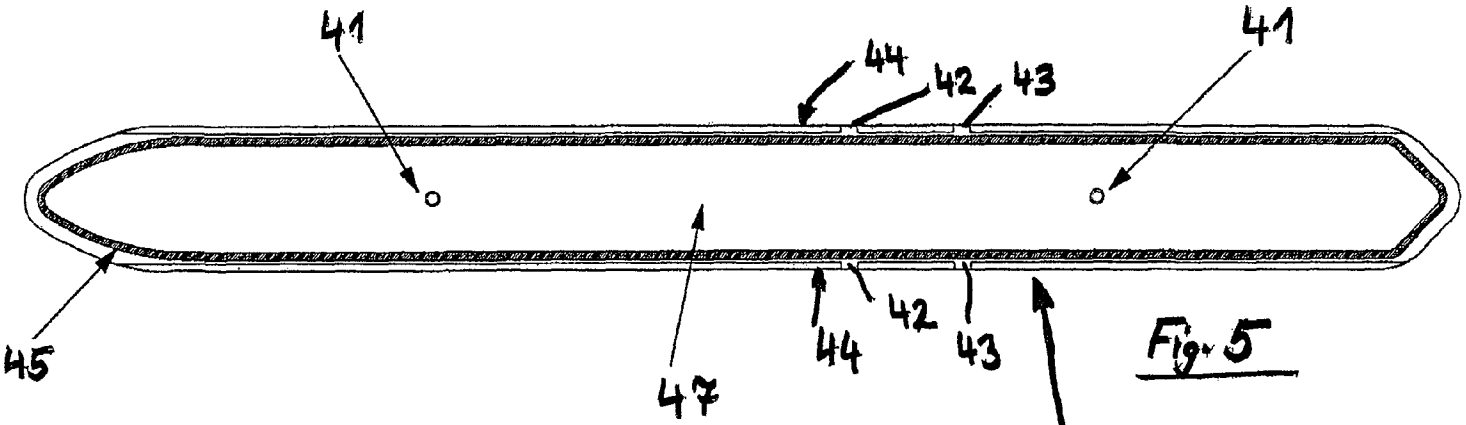
FIG. 5 is a view from below of the mounting plate according to FIG. 1.
Figure 6:
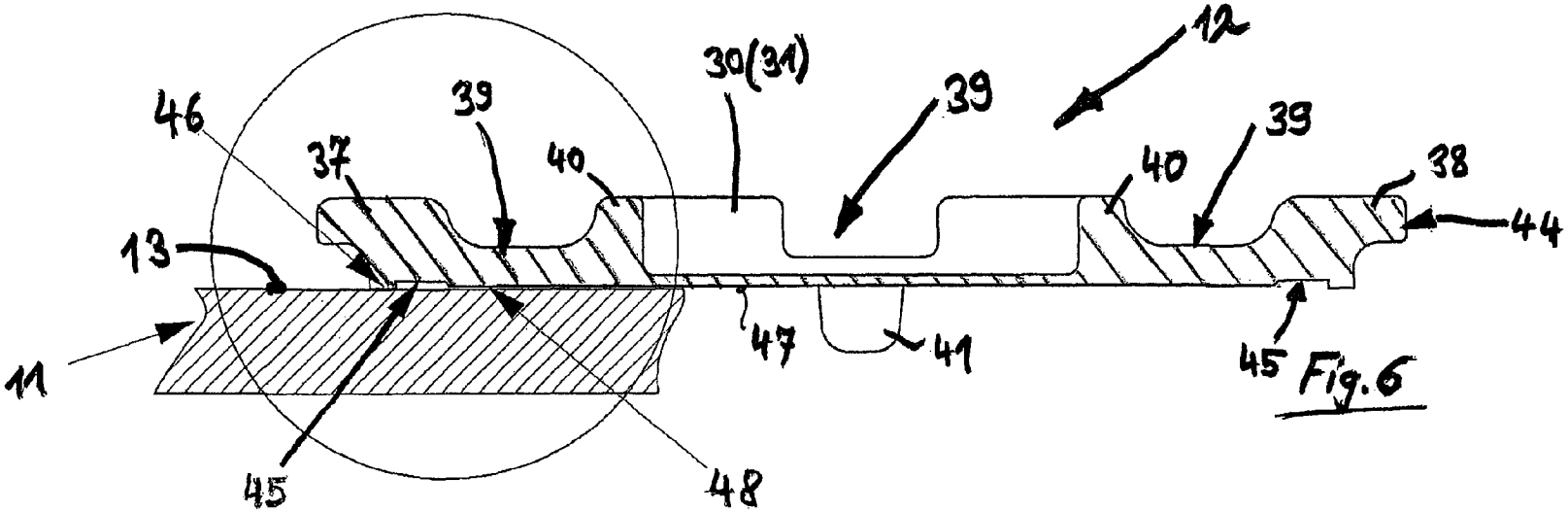
FIG. 6 is a cross-section of the mounting plate according to FIG. 1 along the line VI-VI in FIG. 1.

According to FIGS. 5 and 6, there is provided on the underside of the mounting plate 12, that is, on the side facing the top face of the ski, a groove 45 for accommodating excess adhesive, which extends close to the peripheral edge 44. The groove 45 is bounded on the outside by a land 46 that projects slightly, that is, by about 0.1 mm, beyond the underside level 47 of the central base portion 39. As a result, a correspondingly narrow gap is formed between the underside of the central base portion 39 of the mounting plate on the one hand, and the top face of the ski on the other hand, that gap region being bounded at the edge side by the groove 45. The groove 45 furthermore has a depth of approximately from 0.15 to 0.25 mm relative to the central base portion 39, that is, to the underside level 47 thereof. As a result of that construction, a uniformly thin distribution of adhesive between mounting plate 12 and ski top-face is achieved, which ensures an extremely high degree of bonding between those two components, with the result that the binding detaches from the mounting plate rather than the mounting plate detaching from the ski top face.

Referring to FIGS. 1 and 6, it should also be mentioned that the transverse extent of the channels 30, 31 and locking recesses 36 corresponds to approximately from 35% to 65% of the total width of the mounting plate 12.

Finally, in terms of the total concept it should be mentioned, in addition, that the mounting plate shown makes it possible in a simple manner for the binding to be positioned in front of, in, or behind the centre of gravity of the ski or similar device for sliding on snow. Furthermore, the heel plate can be adapted in a simple manner to different sizes of shoe.

In respect of both of the above-mentioned projections 42, 43 which act as stops, it should be mentioned, in addition, that their spacing is approximately from 30 mm to 40 mm.

In FIG. 6 there is otherwise shown, in addition, a portion of a ski body 11 having a ski top-face 13.

All of the features disclosed in the application documents are claimed as being important to the invention, insofar as they are novel, individually or in combination, with respect to the prior art.

REFERENCE NUMERALS

10 transverse land
11 ski
12 mounting plate
13 ski top-face
30 channel
31 channel
36 locking recess
37 longitudinal edge
38 longitudinal edge
39 central base portion
40 longitudinal land
41 positioning pin
42 front projection
43 rear projection
44 peripheral edge
45 groove
46 land
47 underside level of the central base portion 39
48 adhesive-accommodating region

The invention claimed is:

1. A device for sliding on snow, comprising:

a ski having a top face;

a mounting plate secured to the top face of the ski wherein the mounting plate is made of plastic material, said mounting plate comprising one or more elements that are configured to associate with a binding or parts thereof, wherein the mounting plate comprises two longitudinal edges and a central base portion, the edges being raised relative to the central portion so that they define an undercut longitudinal guide for the binding or a binding plate wherein the mounting plate is thin and flexible relative to the ski and is bonded with a thinner layer of adhesive over essentially its entire bottom surface directly onto the top face of the ski without screws and with essentially no intervening materials other than the adhesive in such a manner that it effectively defines a structural unit therewith and wherein the modulus of elasticity "E" of essentially all parts of the mounting plate are appreciably lower than that of the ski, the modulus of elasticity "E" of essentially all parts of the mounting plate being approximately from 500 to 2000 MPa, and the modulus of elasticity "E" of the ski being approximately from 10 to 60 GPa.

2. A device according to claim 1, wherein the mounting plate comprises an underside having a peripheral edge, the underside having a groove extending adjacent the peripheral edge, for accommodating excess adhesive.

3. A device according to claim 2, wherein the central base portion has an underside defining an underside level and the groove is bounded on its outside by a portion that projects beyond the underside level of the central base portion.

4. A device according to claim 3, wherein the groove has a depth of approximately from 0.15 mm to 0.25 mm relative to the underside level of the central base portion.

5. A device according to claim 1, wherein the mounting plate comprises an underside having positioning lugs or pins that correspond to corresponding positioning openings in the top face of the body.

* * * * *